United States Patent [19]

Tanaka

[11] 4,432,447

[45] Feb. 21, 1984

[54] COIN DETECTING DEVICE FOR A COIN SORTING MACHINE

[75] Inventor: Akio Tanaka, Kanagawa, Japan

[73] Assignee: Fuji Electric Co., Ltd., Kawasaki, Japan

[21] Appl. No.: 928,023

[22] Filed: Jul. 25, 1978

[30] Foreign Application Priority Data

Jul. 25, 1977 [JP] Japan ..... 52-89095

[51] Int. Cl.[3] ..... G07D 5/08

[52] U.S. Cl. ..... 194/100 A; 133/3 R

[58] Field of Search ..... 194/97 R, 99, 100 R, 194/100 A, 107, 102, 1 K; 73/163; 133/3 R, 3 H

[56] References Cited

U.S. PATENT DOCUMENTS

| | | | |
|---|---|---|---|
| 3,401,780 | 9/1968 | Jullien-Davin | 194/100 R |
| 4,108,296 | 8/1978 | Hayashi et al. | 194/99 |
| 4,124,111 | 11/1978 | Hayashi | 194/100 A X |

*Primary Examiner*—F. J. Bartuska

*Attorney, Agent, or Firm*—Sughrue, Mion, Zinn, Macpeak, and Seas

[57] ABSTRACT

A coin sorting device is provided for discriminating between a true coin of a desired denomination and a particular coin similar in configuration to the desired coin. The sorting device includes a coil adjacent the coin passage for detecting the passage of a coin and a detecting circuit which is finely tuned enough to discriminate between the two similar coins.

1 Claim, 21 Drawing Figures

COIN DETECTING DEVICE FOR A COIN SORTING MACHINE

BACKGROUND OF THE INVENTION

This invention relates to a coin detecting device in a coin sorting machine used, for instance, in an automatic vending machine, in which a sorting coil for inspecting the characteristics of a coin inserted thereinto is arranged along a coin rolling passageway, and the variation in impedance of the sorting coil caused when a coin passes through the sorting coil is detected to determine whether the coin is a true coin or a false coin. Such a coin detecting device positively discriminates coins different in monetary value from one another but equal in physical characteristics to one another and detects the passage of each coin inserted thereinto.

Typically, the following three coin sorting systems employing the sorting coil described above are known in the art. A first one is a bridge circuit system in which a bridge circuit is constituted by the sorting coil, a standard impedance element compared with the sorting coil, and two fixed elements, and the balance of the bridge circuit which takes place when a coin passes through the sorting coil is detected. A second one is a frequency detection system in which an oscillation circuit is made up of the sorting coil employed as its oscillation element, and the variation of the oscillation frequency of the oscillation circuit which takes place when a coin passes through the sorting coil is detected. A third one is an induced voltage detecting system in which the sorting coil is constituted by a signal transmitting coil and a signal receiving coil which are arranged on both sides of a coin passageway, and the variation of a voltage induced in the signal receiving coil when a coin passes between the two coils is detected. These systems are similar to one another in that a coin is sorted out depending on whether or not a sorting signal based on the output of the sorting coil adapted to detect the material, thickness, diameter, shape, etc. of a coin is within a predetermined coin determination reference range.

In sorting out coins according to the bridge circuit system, the bridge circuit is balanced by inserting a true coin, and the output of the bridge circuit is zero. However, when a false coin which is equal in material to a true coin but larger in diameter that the true coin is inserted, the impedance variation of the sorting coil is greater than that in the case of inserting the true coin, and therefore the bridge circuit is balanced twice. In other words, the amount of impedance variation of the sorting coil with the false coin is greater than the amount of impedance variation of the sorting coil with the true coin, and therefore the point where the impedance of the sorting coil coincides with the impedance of the sorting coil which satisfies the balance condition of the bridge circuit occurs twice. Thus, the bridge circuit twice provides the output which is similar to that provided when the true coin is inserted, which results in an error. Such an error takes place also in the frequency detection system and the induced voltage detecting system.

In a coin sorting machine for sorting out coins in various monetary denominations, it is necessary to sort out coins separately according to the denominations and to distribute them separately according to the denominations. However, if coins different in denomination are successively inserted into the machine and the distance between adjacent coins rolling along the coin passageway is less than a predetermined value, before the condition of a coin distributing member is changed from its condition for the first coin to its condition for the second coin, the second coin reaches the coin distributing member, as a result of which the second coin is distributed in the same manner as the first coin. Therefore, in the case where the inserted coins are to be put into, for instance, a coin tube where coins used as change money are to be stacked, coins different in denomination may be put in the same coin tube. In addition, if the diameter of the second coin is larger than the diameter of the first coin, coin jamming may be caused in the machine.

In order to overcome the above-described difficulty, there has been proposed a coin sorting machine in which first and second coin detecting switches are provided respectively upstream and downstream of a sorting coin along the coin passageway, the first coin detecting switch spaced a predetermined distance from the second one, to thereby detect the position of a coin rolling along the coin passage. In this conventional machine, the period of time which elapses from the instant that an inserted coin is detected by the first coin detecting switch until the inserted coin is detected by the second coin detecting switch is employed as a coin sorting period, and when a coin sorting signal is provided only once during the coin sorting period, the coin is determined as a true coin, and when the coin sorting signal is provided twice or more or no coin sorting signal is provided, the coin is determined as a false coin. Furthermore, in the same machine, in order to detect the fact that the distance between adjacent coins inserted thereinto is less than the predetermined value, it is detected if, during the period of time which elapses from the instant that the firstly inserted coin is detected by the first coin detecting switch until it is detected by the second coin detecting switch, the secondly inserted coin is detected by the first coin detecting switch. In other words, if, before the firstly inserted coin is detected by the second coin detecting switch, the secondly inserted coin is detected by the first coin detector, then the coin insertion is determined as successive coin insertion.

With this machine, it is possible to segregate a false coin which is equal in material to a true coin but larger in diameter than the true coin, from the true coin, and to detect the successive coin insertion with ease. Since coins to be sorted out by the machine are current coins, some of them are worn out. In general, such worn-out coins are abraded at their peripheral portions. Accordingly, in order to determine the worn-out coin as a true coin, the balance state of the bridge circuit is detected with a certain tolerance such that it is determined as a true coin not when the bridge output is completely zero but when the bridge output approaches zero. Therefore, the conventional machine has a high probability of accepting an unwanted coin which is different in denomination from a wanted coin which is to be sorted out but similar in characteristic to the wanted coin. In other words, the unwanted coin equal in material and thickness to the wanted coin but different in diameter and configuration from the wanted coin is segregated as acceptable together with the wanted coin. More specifically, a German 1-mark coin and a British 5-pence coin are segregated as the same denomination coins.

In a particular coin sorting system, a false coin different in material and thickness from a wanted coin to be sorted out may sometimes be sorted out as a true coin. In general, such false coins are different in configuration, outside diameter and appearance (coin surfaces). The detailed description of kinds of coins to be sorted out, and kinds of coins or false coins (hereinafter referred to as particular coins, when applicable) similar in characteristic to the coins to be sorted out, will be omitted, as to do otherwise may cause a social problem. At any rate, it is necessary to provide an apparatus which is capable of rejecting particular coins and coins which may be newly publicly issued by the government and are similar in characteristic to the existing coins, without greatly modifying the conventional coin sorting machines, and which apparatus can be utilized for sorting out the particular coins.

SUMMARY OF THE INVENTION

Accordingly, an object of this invention resides in the following. That is, in a coin sorting machine in which a sorting coil for detecting the characteristics of a coin inserted thereinto is arranged along a coin rolling passageway, and the impedance variation caused in the sorting coil when a coil passes through the sorting coil is detected to determine whether the coin is a true coin or a false coin, a particular coin, which is similar in characteristic to a coin to be sorted out and which causes the impedance of the sorting coil to vary similarly as in the case of the coin to be sorted out, is rejected.

Another object of the invention is to provide a device which is capable of rejecting a particular coin, without affecting its capability of rejecting a false coin, which is similar in material to a true coin but larger in diameter than the true coin, and of rejecting coins which are successively inserted thereinto.

These and other objects are achieved by providing in the coin passageway an additional sensing device sufficiently finely tuned to discriminate between two very similar coins of different denominations. The device can also detect the passage of two coins closely in succession to one another and can reject both the closely inserted coins and the particular similar coin without affecting the ability of the machine to otherwise reject a false coin. In the preferred embodiment, the additional sensing device includes a transmitting coil and detecting coil in opposite sides of the coin passageway and a circuit for subjecting the potential in the detecting coil to a three level comparison. When the detection signal is between the closely adjacent threshold levels, the coin is detected as being the particular coin which is very similar to the desired true coin and a two pulse identification signal is outputted. When two true coins pass the device within a predetermined short time, a two pulse output is also provided since one pulse identifies a true coin. In either case, the coins are rejected.

BRIEF DESCRIPTION OF THE DRAWINGS

One embodiment of the invention will be described with reference to the accompanying drawings, in which:

FIGS. 7(a) to 7(e) and 8(a) to 8(k) are diagrams illustrating various waveforms for a description of the operation of the embodiment of the invention.

DETAILED DESCRIPTION OF THE INVENTION

Figure 1:
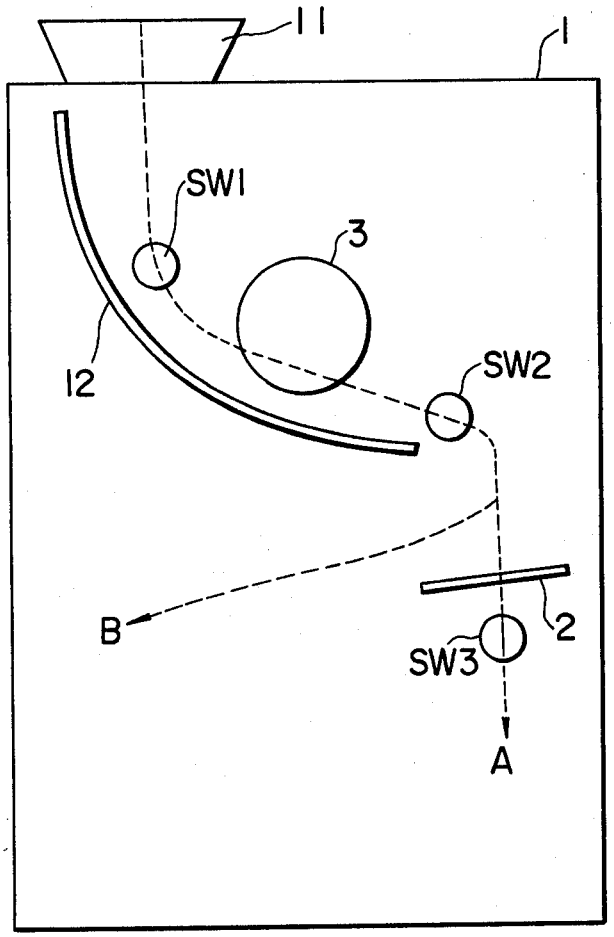
FIG. 1 is an explanatory diagram showing essential components of a coin sorting machine according to the invention.

Referring to FIG. 1, reference numeral 1 designates a coin sorting machine body; reference numeral 11, a coin inlet; reference numeral 12, a coin rolling passageway protruded from the machine body 1; a reference numeral 2, a coin distribution member which is selectively protruded and retracted from the machine body 1 by means of the iron core of an electromagnet means (not shown), to thereby distribute an inserted coin in a coin receiving direction A or in a coin returning direction B; reference numeral 3, a sorting coil disposed along the coin rolling passageway 12; and reference characters SW1, SW2 and SW3, coin detecting sections, more specifically the coin detecting section SW1 comprising a signal receiving coil, each of the coin detecting sections SW2 and SW3 comprising a light emission diode and a photo-transistor.

Figure 2:
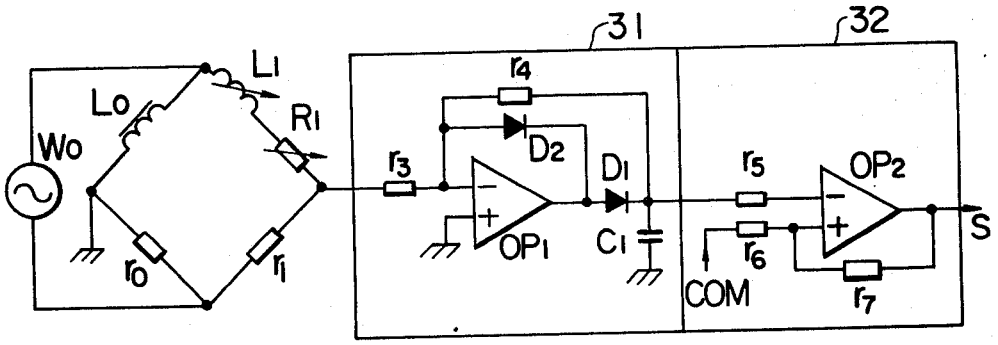
FIG. 2 is a schematic circuit diagram showing a coin sorting circuit of the type having a bridge system employing the sorting coil.
Figure 3:
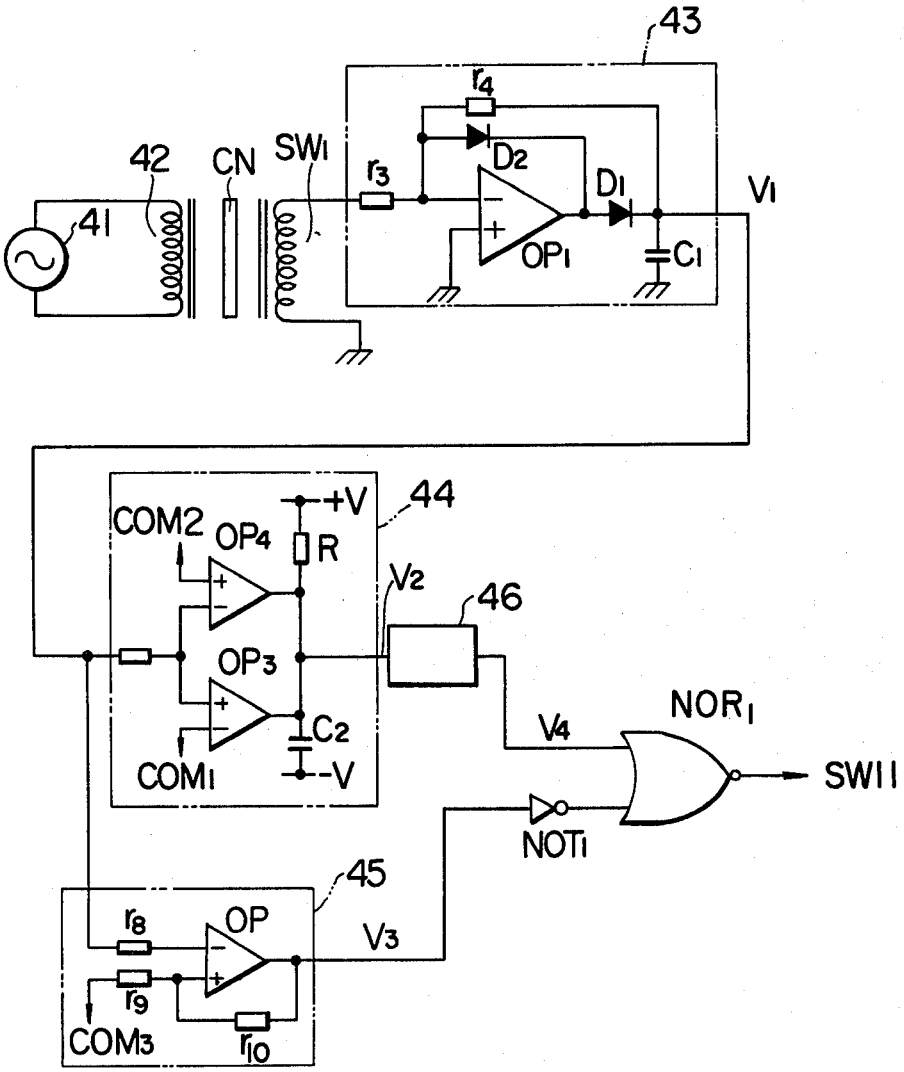
FIG. 3 is a schematic circuit diagram illustrating a coin detecting section for detecting a particular coin different in diameter.

The sorting coil 3 is employed as one side of a bridge circuit, that is, it is an impedance $L_0$ forming one side of the bridge circuit, as shown in FIG. 2. The coin detector SW1, as shown in FIG. 3, comprises a signal receiving coil cooperating with a signal transmitting coil 42 connected to an oscillation circuit 41. When no coin is present between the signal receiving coil and the signal transmitting coil, a predetermined voltage is induced in the receiving coil SW1. On the other hand, if there is a coin CN between the signal receiving coil and the signal transmitting coil, the induced voltage is varied according to the nature, diameter and shape of the coin.

A coin inserted into the coin inlet 11 passes through the signal receiving coil SW1, the sorting coil 3 and the coin detector SW2 in the stated order along the coin rolling passage 12 as indicated by the dashed line in FIG. 1, and it is determined whether the coin is a true coin or a false coin. If the coin is a true coin, the distributing member 2 is retracted from the coin sorting machine 1. Therefore, the coin is forwarded in the direction of the arrow A; that is, it is allowed to drop through the coin detector SW3. On the other hand, if the coin is a false coin, the distributing member 2 remain protruded from the coin sorting machine 1. Therefore, the coin is forwarded in the direction of the arrow B.

The bridge circuit whose one side is the sorting coil 3 is as indicated in FIG. 2, in which reference character $L_0$ designates the impedance of the sorting coil 3 and reference characters $L_1$ and $R_1$ designate a standard inductance and a standard resistance, respectively, which are defined according to the characteristics of a coin to be sorted out and are employed as standard impedances. An oscillator $\omega_0$ is connected between the connection point of resistors $r_1$ and $r_2$ and the connection point of the impedances $L_0$ and $L_1$. The output terminal of the bridge circuit is connected through a resistor $r_3$ to one input terminal of an operational amplifier $OP_1$ the other input terminal of which is grounded. A diode $D_2$ is connected between the output terminal of the same. A resistor $r_4$ is connected between the cathode of a diode $D_1$ connected to the output terminal of the operational amplifier $OP_1$ and the one input terminal of the operational amplifier $OP_1$. The cathode of the diode $D_1$ is connected to one terminal of a smoothing capacitor $C_1$ the other terminal of which is grounded. A rectifying and smoothing circuit 31 is formed by the aforementioned operational amplifier $OP_1$, resistors $r_3$ and $r_4$, diodes $D_1$ and $D_2$ and smoothing capacitor $C_1$. The output terminal of the rectifying and smoothing circuit is connected through a resistor $r_5$ to one input terminal of an operational amplifier $OP_2$, the other input terminal of which is connected through a resistor $r_7$ to the output terminal of the amplifier $OP_2$. A predetermined voltage COM is applied through a resistor $r_6$ to the other input terminal of the operational amplifier $OP_2$. A comparison circuit 32 is constituted by the operational amplifier $OP_2$.

When there is no coin at the position of the sorting coil 3, the bridge circuit outputs a high unbalanced voltage. When a true coin passes through the sorting coil 3, its impedance is varied, as a result of which the bridge circuit is balanced, that is, the output of the bridge circuit becomes zero. The output of the bridge circuit is rectified and smoothed by the rectifying and smoothing circuit 31, and is compared with the reference voltage COM close to zero potential in the comparison circuit 32. Therefore, when the output of the bridge circuit becomes lower than the reference voltage COM while approaching the zero potential, a sorting signal S is outputted by the comparison circuit 32.

FIG. 3 is a circuit diagram of a coin detecting section comprising the signal receiving coil SW1 shown in FIG. 1. The signal receiving coil SW1 is confronted with a signal transmitting coil 42 connected to an oscillator 41. A coin CN inserted into the machine passes between the signal receiving coil SW1 and the signal transmitting coil 42. One terminal of the signal receiving coil SW1 is grounded, while the other terminal of the coil SW1 is connected to a rectifying and smoothing circuit 43 comprising an operational amplifier $OP_1$, resistors $r_3$ and $r_4$, diodes $D_1$ and $D_2$, and a smoothing capacitor $C_1$, so as to smooth a voltage induced in the signal receiving coil SW1. The output of the rectifying and smoothing circuit 43 is connected to a window comparator 44 and a comparison circuit 45. The window comparator 44 comprises an operational amplifier $OP_3$ which receives the output of the rectifying and smoothing circuit 43 and a first predetermined reference voltage $COM_1$ through its input terminals, respectively, and an operational amplifier $OP_4$ which receives the output of the circuit 43 and a second predetermined reference voltage $COM_2$ through its input terminals, respectively. The output terminals of the two operational amplifiers $OP_3$ and $OP_4$ are connected to the connection point of a resistor R and a capacitor $C_2$ which are series-connected between a positive electrical source +V and a negative electrical source −V. The window comparator 44 operates to provide an output $V_2$ when the output voltage $V_1$ of the rectifying and smoothing circuit 43 is between the first reference voltage $COM_1$ of the amplifier $OP_3$ and the second reference voltage $COM_2$ of the amplifier $OP_4$ and this state is maintained for a period of time which is defined by the time constant of the resistor R and the capacitor $C_2$.

On the other hand, a comparison circuit 45 comprises an operational amplifier $OP_5$ which receives the output of the rectifying and smoothing circuit 43 and a third predetermined reference voltage $COM_3$ through its input terminals, respectively, and resistors $r_8$, $r_9$ and $r_{10}$. The comparison circuit 45 provides an output when the output $V_3$ of the rectifying and smoothing circuit 43 becomes lower than the third reference voltage $COM_3$. The output of the comparison circuit 45 is applied through an inverter circuit NOT to one input terminal of a NOR circuit $NOR_1$, to the other input terminal of which the output terminal of the window comparator 44 is connected through a Schmitt trigger circuit 46. The output of the NOR circuit $NOR_1$ is employed as a detection signal SW1 of a coin inserted or a sorting signal of a particular coin.

The operation of the circuitry shown in FIG. 3 will be described with reference to waveforms shown in FIG. 7. FIGS. 7(a), 7(b), 7(c), 7(d) and 7(e) indicate the output $V_1$ of the rectifying and smoothing circuit 43, the output $V_2$ of the window comparator 44, the output $V_4$ of the Schmitt trigger circuit 46, the output $V_3$ of the comparison circuit 45 and the output SW1 of the Nor circuit $Nad_1$, respectively. In FIG. 7(a), time t is plotted on the horizontal axis, while output voltage is plotted on the vertical axis. Reference character Vc indicates a standby voltage induced in the signal receiving coil in a standby state where no coin is present between the signal transmitting coil 42 and the signal receiving coil SW1; reference character $VCOM_3$ indicates the third reference voltage $COM_3$ of the comparator circuit 45 which is slightly lower than the standby voltage Vc, and reference characters $VCOM_1$ and $VCOM_2$ designate the first and second reference voltages $COM_1$ and $COM_2$ of the window comparator 44, respectively.

When there is no coin between the signal receiving coil SW1 and the signal transmitting coil 42, the standby voltage Vc is induced in the signal receiving coil SW1 by a magnetic field created by the signal transmitting coil 42. When a particular coin enters the magnetic field formed by the signal transmitting coil 42, the voltage induced in the signal receiving coil SW1 is gradually decreased. The output $V_1$ obtained by rectifying and smoothing a voltage which is induced in the signal receiving coil SW1 by this particular coin is indicated by the solid line in FIG. 7(a), and the output $V_1$ obtained by rectifying and smoothing a voltage which is induced in the signal receiving coil SW1 by a coin smaller in diameter than the particular coin is indicated by the two-dot chain curve. In addition, the output $V_1$ obtained by rectifying and smoothing a voltage which is induced in the signal receiving coil SW1 by a coin larger in diameter than the particular coin is indicated by the dashed curve in FIG. 7(a). When the voltage induced in the signal receiving coil SW1 is decreased by the particular coin entering thereinto until finally it becomes lower than the third reference voltage $COM_3$ of the comparison circuit 45, the latter 45 provides the output $V_3$ as indicated in the part (d) of FIG. 7.

Figures 7A, 7B, 7C, 7D, 7E:
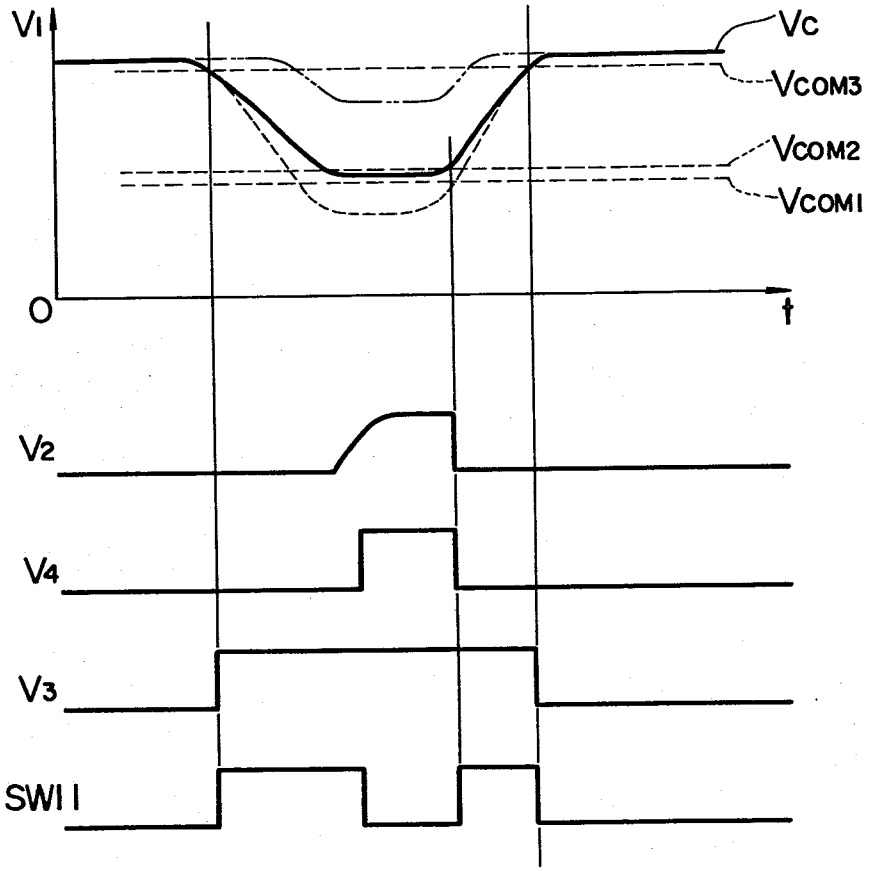

If when a particular coin passes between the signal transmitting coil 42 and the signal receiving coil SW1 whereby the voltage induced in the receiving coil SW1 is reduced, a state is maintained in which the output $V_1$ is lower than the second reference voltage $COM_2$ of the window comparator 44 but is higher than the first reference voltage $COM_1$; that is, if the output $V_1$ is between the first reference voltage $COM_1$ and the second reference voltage $COM_2$ for the period of time defined by the time constant of the resistor R and the capacitor $C_2$, then the comparator 44 provides the output $V_2$ as indicated in FIG. 7(b). The output $V_2$ of the comparator 44 is shaped into a square wave in the Schmitt trigger circuit 46, as a result of which the output $V_4$ as indicated in FIG. 7(c) is applied from the Schmitt trigger circuit 46 to one input terminal of the NOR circuit $NOR_1$. A signal obtained by inverting the output $V_3$ of the comparison circuit 45 by the inverter circuit NOT is applied to the other input terminal of the NOR circuit $NOR_1$. Therefore, the output SW11 of the NOR circuit $NOR_1$ becomes a two-pulse signal as indicated in FIG. 7(e). This output SW11 of the NOR circuit $NOR_1$ is utilized as a detection signal detecting the passage of a coin. When the two-pulse signal is provided as the detection signal, the coin is determined as the particular coin. There are a variety of methods of determining a coin as the particular coin; however, one example of a method will be described below.

If, in the case of a coin other than the particular coin, the output $V_1$ of the waveform shaping circuit 43 is varied, for instance, as indicated by the two-dot chain line in FIG. 7(a), then a single pulse whose pulse width corresponds to the period of time during which the output $V_1$ is lower than the third reference voltage $COM_3$ of the comparison circuit 45 is provided as the detection signal SW11 by the NOR circuit $NOR_1$. In addition, if the output $V_1$ is varied as indicated by the dotted line in FIG. 7(a), a pulse, whose pulse width corresponds to the period of time during which the output is lower than the third reference voltage $COM_3$ of the comparison circuit 45, is provided as the detection signal. In this case, the output $V_1$ indicated by the dotted line has a period of time during which it is between the first and second reference voltages $COM_1$ and $COM_2$ of the window comparator 44. Since this period of time is shorter than the period of time which is defined by the time constant of the resistor R and capacitor $C_2$, no output $V_2$ is provided, or even if the output $V_2$ is provided it is low. In other words, the output $V_2$ does not reach the trigger level of the Schmitt trigger circuit 46 and, accordingly, the output $V_4$ of the Schmitt trigger circuit 46 is not provided. As is apparent from the above description, the coin detecting section operates to detect a coin and to output the detection signal. The coin detecting section outputs two pulses when the particular coin is inserted into the machine and one pulse when a coin other than the particular coin is inserted thereinto.

Now, a method of determining whether a coin inserted into the coin sorting machine is a true coin or a false coin will be described.

Figure 4:
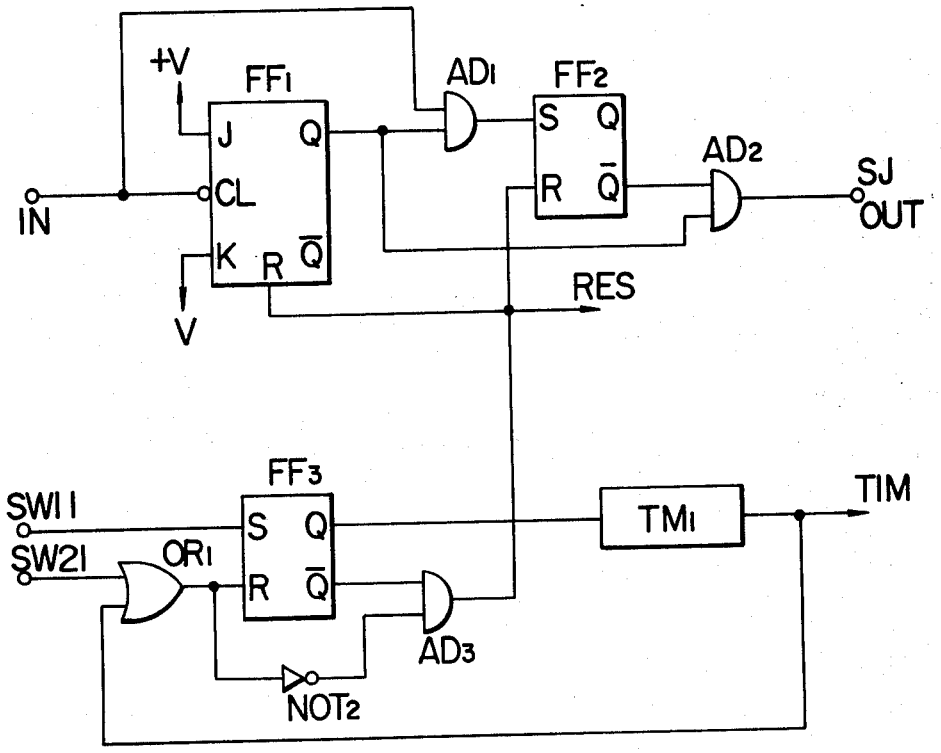
FIG. 4 shows a circuit for discriminating a coin according to the bridge system.

Shown in FIG. 4 is a circuit for determining whether a coin is a true coin or a false coin (hereinafter referred to as "a coin determining circuit" when applicable). Its input terminal IN is connected to the output terminal of the comparison circuit 32 shown in FIG. 2. The coin detection signals are applied to terminals SW11 and SW21, which are connected to the output terminals of the NOR circuit $NOR_1$ in FIG. 3 and the coin detector SW2, respectively. The input terminal IN is connected to the clock pulse input terminal CL of a J-K flip-flop FF1, the terminals J and K of which are connected to the positive electrical source +V and the negative electrical source −V, respectively. The output terminal Q of the flip-flop FF1 is connected to one input terminal of an AND circuit $AD_1$, to the other input terminal of which the signal applied to the terminal CL of the flip-flop FF1 is also applied. The output terminal of the AND circuit $AD_1$ is connected to the terminal S of an R-S flip-flop FF2, the output terminal $\overline{Q}$ of which is connected to one input terminal of an AND circuit $AD_2$, to the other input terminal of which the output Q of the flip-flop FF1 is applied. The terminal SW11 receiving the coin detection signal SW11 is connected to the terminal S of a flip-flop FF3, the output terminal $\overline{Q}$ of which is connected to the input terminal of a timer $TM_1$. The terminal SW21 is connected to one input terminal of an OR circuit $OR_1$, to the other input terminal of which the output of the timer $TM_1$ is applied. The output terminal of the OR circuit $OR_1$ is connected to the terminal R of the flip-flop FF3, and is connected through an inverter circuit $NOT_2$ to one input terminal of an AND circuit $AD_3$, the other input terminal of which is connected to the output terminal $\overline{Q}$ of the flip-flop FF3. The output terminal of the AND circuit $AD_3$ is connected to the terminals R of the flip-flops FF1 and FF2.

The operation of the circuitry shown in FIG. 4 will now be described. Before a coin is inserted into the coin inlet 11 shown in FIG. 1, the output of the OR circuit $OR_1$ is at a logical signal "0" (hereinafter referred to as a signal "0", or "0", when applicable), and the flip-flop FF3 is in a reset state. Accordingly, the AND condition of the AND circuit $AD_3$ is satisfied, and a logical signal "1" (hereinafter referred to as a signal "1", or "1", when applicable) is applied to the terminals R of the flip-flops FF1 and FF2.

Figures 8A, 8B, 8C, 8D, 8E, 8F, 8G, 8H, 8J, 8K:
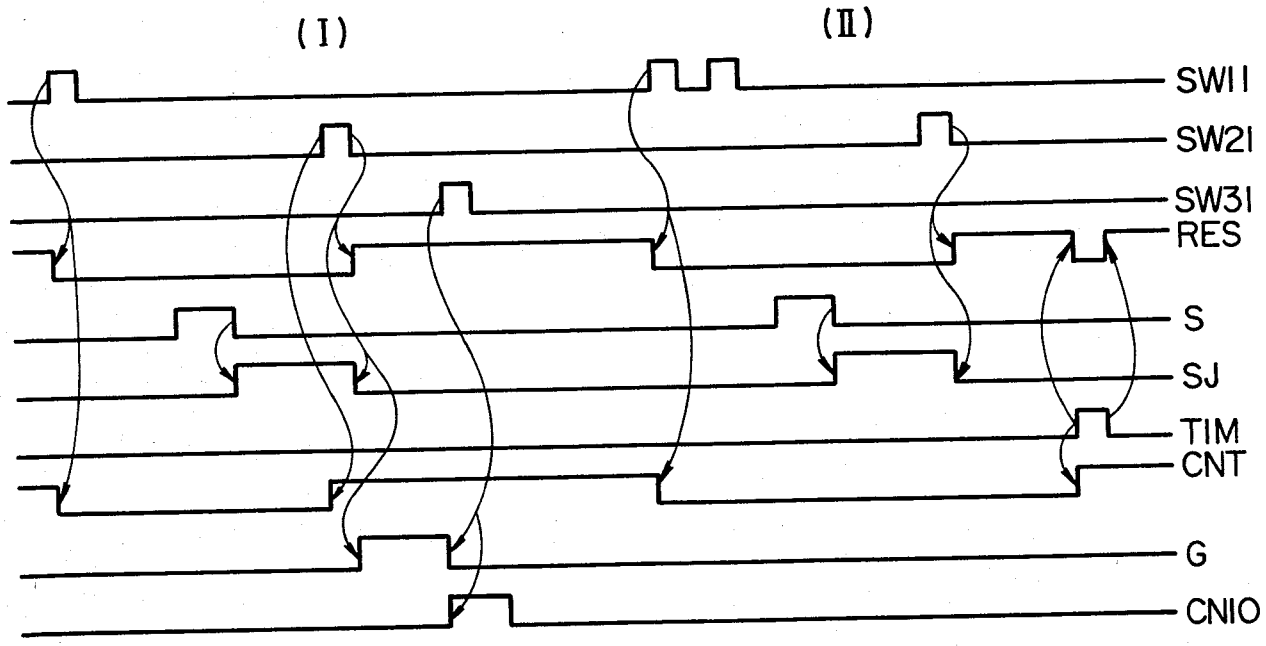

When a coin is inserted into the coin inlet 11 shown in FIG. 1, the coin first passes through the signal receiving coil SW1, and therefore the detection signal SW11 as indicated in the column (I) of FIG. 8(*a*) is applied from the NOR circuit $NOR_1$ shown in FIG. 3 to the terminal SW11. The flip-flop FF3 is set by this detection signal SW11. As a result, the timer $TM_1$ starts its time limit operation, and the signal "0" is provided at the output terminal of the flip-flop FF3. Accordingly, application of the reset input signal to the flip-flops FF1 and FF2 from the AND circuit $AD_3$ is released, whereupon a sorting period of time begins as indicated in FIG. 8(*d*). After passing through the signal receiving coil SW1, the coin reaches the sorting coil 3 and, therefore, the balance state of the bridge circuit is detected, and the sorting signal S as indicated in FIG. 8(*e*) is applied to the terminal IN by the comparison circuit 32. Upon application of the sorting signal S through the input terminal IN to the clock pulse terminal CL of the flip-flop FF1, the latter FF1 is set. As a result, the signal "1" is applied to the input terminals of the AND circuits $AD_1$ and $AD_2$. Since the AND condition of the AND circuit $AD_2$ is satisfied when the flip-flop FF2 is not yet set, a determining signal SJ as indicated in FIG. 8(*f*) is provided by the AND circuit $AD_2$. In this connection, if a coin is made of the same material as a true coin but is larger in diameter than the true coin, the bridge circuit is balanced twice and, accordingly, two pulses are applied as the sorting signals S to the input terminal IN. Therefore, the flip-flop FF2 is set by the second pulse of the two pulses. In other words, only the flip-flop FF1 is set when the sorting signal is provided only once; while the flip-flop FF2 is also set when the sorting signal is provided twice or more.

When the sorting signal is provided twice or more, the flip-flop FF2 is set as described above and, therefore, no determining signal SJ is provided by the AND circuit $AD_2$. When only the flip-flop FF1 is set, the determining signal SJ is outputted by the AND circuit $AD_2$. This determining signal is processed by subjecting it and the output signal of the coin detector SW2 to AND operation.

After passing through the sorting coil 3, the coin reaches the coin detector SW2, whereupon the detection signal SW21 is applied to the terminal SW21 by the detector SW2. This detection signal SW21 is applied through the OR circuit $OR_1$ to the terminal R of the flip-flop FF3, and to the one input terminal of the AND circuit $AD_3$ through the inverter circuit $NOT_2$. When the flip-flop FF3 is reset, it applies the signal "1" through its output terminal $\overline{Q}$ to the other input terminal of the AND circuit $AD_3$. Since the signal obtained by inverting the detection signal SW2 has been applied to the AND circuit $AD_3$, the AND condition of the AND circuit $AD_3$ is not satisfied until the detection signal SW21 is eliminated. After elimination of the detection signal SW21, the AND condition of the AND circuit $AD_3$ is satisfied, as a result of which the reset signal is applied to the flip-flops FF1 and FF2. When the flip-flops FF1 and FF2 are reset, the sorting period of time is ended as indicated in the column (I) of FIG. 8(*d*).Thus, discrimination of a coin is carried out depending on whether only the flip-flop FF1 is set or both of the flip-flops FF1 and FF2 are reset during the sorting period of time which elapses from the instant that the reset states of the flip-flops FF1 and FF2 are released by the provision of the detection signal until the flip-flops FF1 and FF2 are reset by the detection signal SW21. The limit time of the timer $TM_1$ is selected to be longer than the sorting period of time. Sometimes an inserted coin does not reach the coin detector SW2, for instance, as in the case where it is jammed or caught in the coin passageway. Furthermore, if the user operates a coin returning lever, requesting the inserted coin to be returned to him, the coin is returned to him without reaching the coin detector SW2. In these cases, the timer $TM_1$ operates to provide an output TIM and the flip-flop FF3 is reset through the OR circuit $OR_1$.

Figure 5:
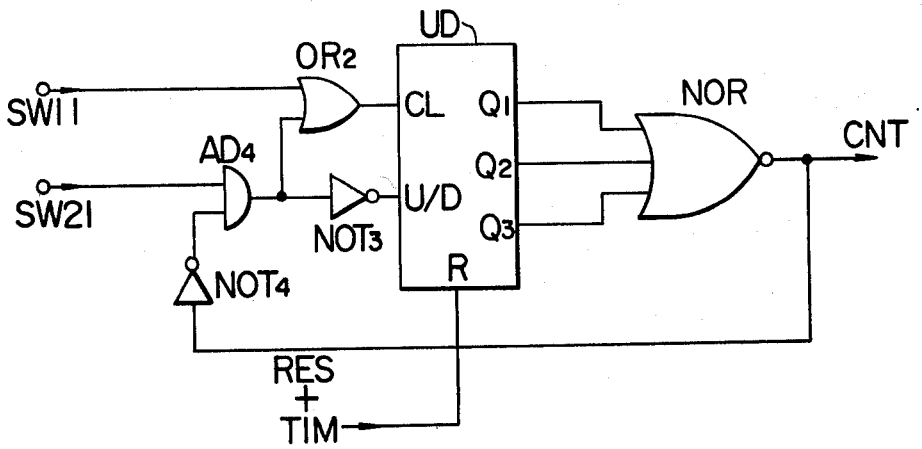
FIG. 5 shows a circuit for determining a particular coin or determining successive coin insertion.

Determination of the particular coin detected by the coin detecting section and determination of continuous coin inserting will now be described. FIG. 5 shows a determination circuit for carry out determination. In FIG. 5, reference characters SW11 and SW21 designate input terminals to which the detection signals SW11 and SW21 are applied, and reference character TIM designates the output of the timer $TM_1$ shown in FIG. 4. The terminal SW11 is connected to one input terminal of an OR circuit $OR_2$, to the other input terminal of which the output of an AND circuit $AD_4$ is applied. The output terminal of the OR circuit $OR_2$ is connected to the clock pulse input terminal CL of an up-down counter UD, the output terminals $Q_1$, $Q_2$ and $Q_3$ of which are connected to the input terminals of a NOR circuit NOR. The output of the NOR circuit NOR is a determination signal, which is applied through an inverter circuit $NOT_4$ to one input terminal of the AND circuit $AD_4$. The other input terminal of the AND circuit $AD_4$ is connected to the input terminal SW21. The output terminal of the AND circuit $AD_4$ is further connected to the addition and subtraction instruction terminal U/D of the up-down counter UD. The output TIM of the timer $TM_1$ shown in FIG. 4 and the output, or the reset signal RES, of the AND circuit $AD_3$ shown in FIG. 4 are introduced to the reset terminal R of the up-down counter UD, for example through an OR gate (not shown).

Before a coin is inserted into the coin inlet 11 shown in FIG. 1, the signals "0 " are provided at the terminals $Q_1$, $Q_2$ and $Q_3$ of the up-down counter UD and, therefore, the output of the NOR circuit NOR is "1". This output is applied through the inverter circuit $NOT_4$ to the one input terminal of the AND circuit $AD_4$; that is, the signal "0" is applied to the one input terminal of the AND circuit $AD_4$. As no detection signal SW21 is applied through the terminal SW21, the output of the AND circuit $AD_4$ is "0". The output "0" is applied through the inverter circuit $NOT_3$ to the terminal U/D of the up-down counter; that is, the signal "1" is applied to the terminal U/D. Therefore, the up-down counter UD is enabled to carry out its addition operation, because the up-down counter UD is so designed that it carries out its addition operation when the signal "1" is applied to the terminal U/D, and it is enabled to carry out its subtraction operation when the signal "0" is applied thereto.

Consider the case where only one coin is inserted into the coin inlet 11 shown in FIG. 1 and it reaches the signal receiving coil SW1. In this case, the detection signal SW11 as indicated in the column (I) of FIG. 8(*a*) is applied from the coin detecting section having the signal receiving coil SW1 through the terminal SW11 and the OR circuit $OR_2$ to the terminal CL of the up-down counter UD, where it is added. As a result, "1" is provided at the output terminal $Q_1$ of the up-down counter UD and, therefore, the output of the NOR circuit NOR is lowered to "0". As this output "0" is inverted by the inverter circuit $NOT_4$, the signal "1" is applied to the one input terminal of the AND circuit $AD_4$.

When the inserted coin reaches the coin detector SW2, the detection signal SW21 as indicated in the column (I) of FIG. 8(*b*) is applied to the AND circuit $AD_4$ to satisfy the AND condition of the latter $AD_4$. When the AND condition of the AND circuit $AD_4$ is thus satisfied, the signal "0" is applied to the addition and subtraction instruction terminal U/D of the up-down counter UD with the aid of the inverter circuit $NOT_3$ as a result of which the up-down counter UD is enabled, or becomes ready, for a subtraction operation. On the other hand, the output of the AND circuit $AD_4$ is applied through the OR circuit $OR_2$ to the terminal CL of the up-down counter UD, to cause the latter UD to carry out the subtraction operation. As a result, the signal "0" is provided at the terminal $Q_1$ of the up-down counter UD, and the output of the NOR circuit NOR is raised to "1". When the detection signal SW21 is eliminated or the output of the NOR circuit NOR is raised to "1", the AND condition of the AND circuit $AD_4$ is not satisfied. Therefore, the output of the AND circuit $AD_4$ is lowered to "0", and accordingly the signal "1" is applied to the terminal U/D of the up-down counter UD, so that the latter UD becomes ready for addition operation. As soon as the detection signal SW2 is eliminated, the reset signal RES is applied to the reset terminal R of the up-down counter UD as described with reference to FIG. 4, and the standby state is obtained again.

In the case where a particular coin is inserted into the coin inlet 11 shown in FIG. 1, as soon as the coin reaches the signal receiving coil SW1, two pulse detection signals SW11 as indicated in the column (II) of FIG. 8(*a*) are applied from the coin detecting section having the signal receiving coil SW1 through the terminal SW11 and the OR circuit $OR_2$ to the clock pulse input terminal CL of the up-down counter UD. The two pulse detection signals are added in the up-down counter UD, whereby the signal "1" is provided at the terminal $Q_2$ of the up-down counter UD, and the output of the NOR circuit NOR is lowered to "0". When the coin reaches the coin detector SW2 after passing through the signal receiving coil SW1, a single pulse detection signal SW21 as indicated in the column (II) of FIG. 8(*b*) is introduced to the terminal SW21. As a result, the AND condition of the AND circuit $AD_4$ is satisfied and, therefore, the signal "0" is applied to the addition and subtraction instruction terminal U/D of the up-down counter UD with the aid of the inverter circuit $NOT_3$, whereby the up-down counter UD becomes ready for subtraction. On the other hand, the output "1" of the AND circuit $AD_4$ is applied through the OR circuit $OR_2$ to the up-down counter UD and, therefore, the detection signal SW21 is subtracted from the content of the up-down counter UD; however, the count content of the latter UD is not zeroed and "1" is provided at the output terminal $Q_1$. Therefore, the output of the NOR circuit NOR is maintained at "0". Thus, by subjecting the output of the NOR circuit NOR and the detection signal SW21 to AND operation, it can be determined that the detection signal SW11 has been provided twice or more. Described above is the case where the particular coin is inserted into the machine. The operation in the case where coins providing two pulses from the signal receiving coil SW1 are successively inserted is similar to that described above. Thus, the description of this operation will be omitted.

The discrimination of an inserted coin, the determination of the particular coin, and the determination of successive coin insertion, as described above, are finally done when an inserted coin is distributed in the coin receiving direction A or in the coin returning direction B by controlling the coin distributing member 2 shown in FIG. 1. Control of the coin distributing member 2 will now be described with reference to FIG. 6, in which reference characters SW21 and SW31 designate input terminals to which the detection signals SW21 and SW31 of the coin detectors SW2 and SW3 are applied, respectively, reference character SJ designates an input terminal connected to the output terminal of the AND circuit $AD_2$ shown in FIG. 4 and receiving the determining signal SJ, and reference character CNT designates an input terminal connected to the output terminal of the NOR circuit NOR shown in FIG. 5 and receiving the determining signal CNT. The input terminals SW21, SJ and CNT are connected to the input terminals of an AND circuit $AD_5$, the output terminal of which is connected to the clock pulse input terminal CL of a flip-flop FF4. The terminals J and K of the flip-fllop FF4 are connected to the positive and negative electric sources +V and −V, respectively. The output terminal Q of the flip-flop FF4 is connected to a control signal delivering terminal G, to the input terminal of a timer $TM_2$, to one input terminal of an AND circuit $AD_6$ the other input terminal of which is connected to the terminal SW21 and to one input terminal of an AND circuit $AD_7$ the other input terminal of which is connected to the terminal SW31. The terminal R of the flip-flop FF4 is connected to the output terminal of an OR circuit $OR_3$ which receives the output of the timer $TM_2$ and the output of the AND circuit $AD_6$. The output terminal of the AND circuit $AD_7$ is connected to the terminal S of a flip-flop FF5, the output terminal Q of which is connected to a coin counting signal delivering terminal $CN_{10}$ and to the input terminal of a timer $TM_3$. The output terminal of the timer $TM_3$ is connected to the terminal R of the flip-flop FF5.

Before a coin is inserted into the coin inlet 11 shown in FIG. 1, both of the flip-flops FF4 and FF5 are in reset state. It is assumed that a true coin is inserted into the coin inlet 11, the determining signal SJ as indicated in the column (I) of FIG. 8(*f*) is applied to the terminal SJ, and the determining signal CNT as indicated in the column (I) of FIG. 8(*h*) is applied to the terminal CNT. When the inserted coin reaches the coin detector SW2, the detection signal SW21 as indicated in the column (I) of FIG. 8(*b*) is applied to the terminal SW21, as a result of which the AND condition of the AND circuit $AD_5$ is satisfied. Therefore, the flip-flop FF4 is set and the signal "1" is applied, as a control signal as indicated in the column (I) of FIG. 8(*j*), to the terminal G through the output terminal Q of the flip-flop FF4. As a result, the coin distributing member 2 shown in FIG. 1 is retracted from the coin sorting machine body 1 by means of an electromagnet means (not shown), so that the inserted coin is allowed to drop in the coin receiving direction A. When this coin reaches the coin detector SW3, the detection signal SW31 as indicated in the column (I) of FIG. 8(*c*) is applied through the terminal SW31 to one input terminal of the AND circuit $AD_7$. In this case, since the signal "1" provided at the terminal Q of the flip-flop FF4 has been applied to the other input terminal of the AND circuit $AD_7$, the AND condition of the latter is satisfied to set the flip-flop FF5. When the flip-flop FF5 is set, "1" is applied, as a coin signal as indicated in the column (I) of FIG. 8(*k*), to the terminal $CN_{10}$ from the output terminal Q of the flip-flop FF5, whereupon the timer $TM_3$ starts its time limit operation. The timer $TM_3$ resets the flip-flop FF5 in a predetermined period of time. On the other hand, the timer $TM_2$ starts its time limit operation when "1" is provided at the terminal Q of the flip-flop FF4. This timer $TM_2$ resets the flip-flop FF4 in the limit time which is determined slightly longer than a period of time required for the inserted coin to pass through the coin distributing member 2.

When the particular coin is inserted or coins are successively inserted, the determining signal CNT is lowered to "0" as indicated in the column (II) of FIG. 8(*h*), and therefore the AND condition of the AND circuit $AD_5$ is no longer satisfied. Accordingly, the reset state of the flip-flop FF4 is maintained, and the control signal for the coin distributing member 2 which is delivered through the terminal G is maintained at "0" as indicated in the column (II) of FIG. 8(*j*). Accordingly, the coin distributing member 2 is maintained protruded from the coin sorting machine body 1 and, therefore, the coin dropping along the coin rolling passageway 12 is blocked by the coin distributing member 2 and is forwarded in the coin returning direction B. In the case where both of the flip-flops FF1 and FF2 shown in FIG. 4 are set within the sorting period of time, upon provision of the detection signal SW21 the determining signal SJ is at "0" as indicated in the column (II) of FIG. 8(*f*). In this case, the AND condition of the AND circuit $AD_5$ is not satisfied, and the inserted coin is forwarded in the coin returning direction B by the coin distributing member 2. When the inserted coin is not allowed to reach the coin detector SW2 by operating the coin returning lever, the timer $TM_1$ shown in FIG.

4 starts the time limit operation to provide the output as shown in the column (II) of FIG. 8(*g*) to thereby reset the up-down counter UD shown in FIG. 5.

Figure 6:
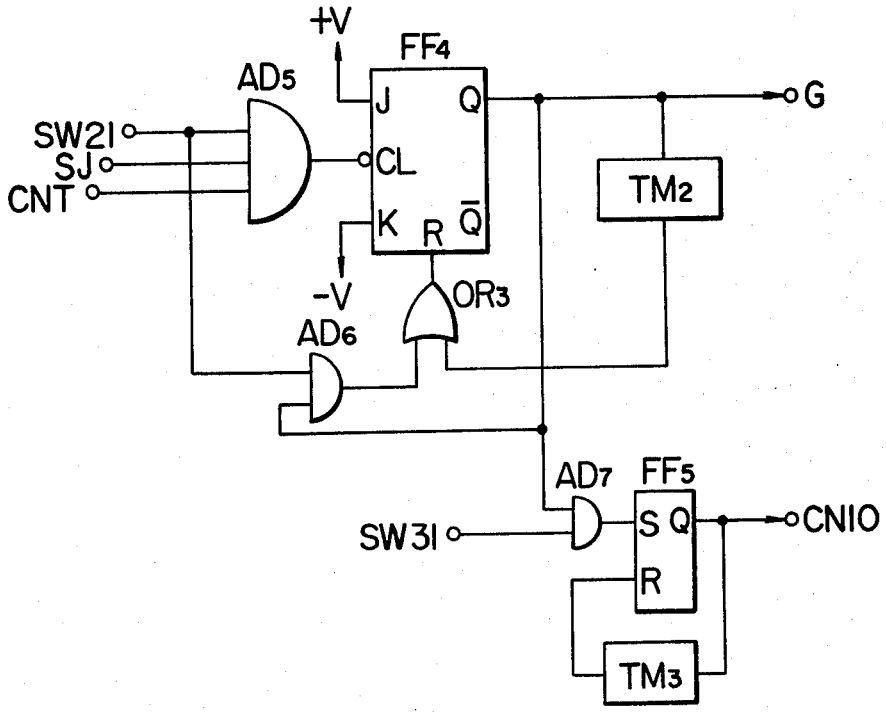
FIG. 6 shows a control circuit for a coin distribution member which distributes coins in a coin receiving direction or a coin returning direction selectively according to coin determining signals representative of a true coin and a false coin.

The AND circuit $AD_6$ in FIG. 6 is needed in the case where, for instance, a signal receiving coil like SW1 is employed for the coin detector SW2. That is, it is provided for the following purpose. If two pulses are provided, as the detection signals at the position of the coin detector SW2, the AND circuit $AD_5$ may be opened with the first pulse. Therefore, the AND circuit $AD_6$ is provided to reset the flip-flop FF4 immediately with the next pulse.

In the above-described embodiment, when the particular coin is inserted, it is rejected. However, the machine may be so designed that the particular coin is detected and sorted out as a true coin rather than returned. That is, the particular false coin can be logically sorted out on the basis of the fact that two coin detection signals are provided by the coin detecting section having the signal receiving coil SW1 shown in FIG. 3 within the coin sorting period and the fact that the bridge circuit is balanced once in the coin sorting period. In the above-described embodiment, only one particular coin is provided. However, in the case where a number of particular coins are provided, the number of coin detecting sections having the signal receiving coils SW1 should be increased in correspondence to the number of particular coins. In the case where the number of particular coins are two, the coin detector SW2 may be replaced by a means which is similar to the coin detecting section having the signal receiving coil SW1 as shown in FIG. 3.

Furthermore, in the above-described embodiment, the coin detecting section having the signal receiving coil SW1 operates to detect both the particular coin and the passage thereof. However, detection of the passage of the particular coin may be accomplished by a method in which coin detectors made up of a light emission diode, a photo-transistor, etc. are provided at the positions SW1 and SW2, and a coin detecting section having a signal receiving coil adapted to detect only the particular coin is disposed between the positions SW1 and SW2. In this case, if the particular false coin detection signal is applied, as the coin detection signal SW11 to the detection signal input terminal SW11 shown in FIG. 5 or to the sorting signal input terminal IN in FIG. 4, the coin can be rejected.

In the above-described embodiment, in order to detect the particular coin, the means associated with the signal transmitting coil and the signal receiving coil detects the variations of the voltage induced in the signal receiving coil when a coin passes between the signal receiving coil and the signal transmitting coil; however, a bridge system may be employed in such a manner that, if the bridge system is operated at a frequency different from the frequency of the sorting device 3, a difference between the desired coin and particular coin can be detected. Furthermore, coin detection can be accomplished by utilizing light in the case where the particular false coin is different in configuration, for instance if it has a hole in the central portion, or in the case where the particular false coin is different in coin surface pattern.

As is clear from the above description, according to the invention, it is possible to detect and reject the particular coin which is similar in characteristic to a coin to be sorted out but different from the latter in configuration or diameter. If necessary, the particular coin can be sorted out as a true coin. Furthermore, it is possible to detect the position of a coin, that is, the passage of the coin, with the detecting means adapted to detect the particular coin. Accordingly, for instance, the situation in which a particular coin different in monetary value is inserted into an automatic vending machine to buy an article higher in monetary value than that coin can be eliminated by employment of the present invention. In addition, in the case where particular coins such as described above are newly publicly issued by the government, the machine can handle these coins without substantially modifying the arrangement thereof. These are significant advantages of the invention which should be highly appreciated.

What is claimed is:

1. A coin detecting device for a coin sorting machine in which a sorting coil for detecting the characteristics of a coin and coin detectors for detecting the passage of a coin are arranged in a coin rolling passageway, successive coin insertion or a coin sorting period is determined by a detection signal provided by said coin detectors, and the variation in impedance of said sorting coil which is caused when a coin passes through said sorting coil is detected to determine whether said coin is a true coin or a false coin, the improvement characterized in that said device further comprises:

discriminating means for discriminating between a true coin and a particular coin by detecting the diameter of the particular coin, said particular coin causing the impedance of said sorting coil to vary in a manner similar to that caused by the true coin, such that the sorting coil erroneously determines that the particular coin is a true coin by generating a sorting signal;

signal transmitting and receiving coils disposed on opposite sides of said coin passageway; and receiving coil detection circuit means for subjecting the signal induced in said receiving coil by a passing coin to first and second level detections, said detection circuit means providing a first output signal indicative of the passage of said particular coin when the level of the signal in said receiving coil is between said first and second levels for a predetermined minimum period of time;

and wherein said detection circuits means subjects said receiving coil signal to a third level detection and outputs a second output signal indicative of the passage of a coin other than said particular coin when said receiving coil signal traverses said third level but is not between said first and second levels for at least said predetermined minimum period of time;

and wherein said first output signal consists of two pulses within said predetermined period, and said second output signal consists of only one pulse within said predetermined period;

and wherein said machine further includes gate means operable for directing true coins along a true coin path and false coins along a reject path; said device further comprising:

up/down counter means responsive to said first and second output signals for producing a count signal only in response to said second output signal; and logic circuit means responsive to a sorting signal and to the absence of said count signal for producing, at the end of said sorting period, a control signal for operating said gate means to direct said particular coin along said reject path.

* * * * *